United States Patent [19]

Limper

[11] 4,191,642

[45] Mar. 4, 1980

[54] METHOD OF SEPARATING GRANULAR POURABLE MATERIALS OF DIFFERENT DENSITIES IN A GASEOUS OR LIQUID MEDIUM

[75] Inventor: Klaus Limper, Gummersbach, Fed. Rep. of Germany

[73] Assignee: L. & C. Steinmüller GmbH, Gummersbach, Fed. Rep. of Germany

[21] Appl. No.: 872,061

[22] Filed: Jan. 25, 1978

[30] Foreign Application Priority Data

Jan. 26, 1977 [DE] Fed. Rep. of Germany ..... 2702987

[51] Int. Cl.[2] ..... B03B 11/00

[52] U.S. Cl. ..... 209/495; 209/158; 209/454

[58] Field of Search ..... 209/158–161, 209/211, 208, 209, 488, 494, 495, 454, 18, 474, 144; 210/33, 35, 189

[56] References Cited

U.S. PATENT DOCUMENTS

| | | | |
|---|---|---|---|
| 1,669,820 | 5/1928 | Grant et al. | 209/211 |
| 2,629,496 | 2/1953 | Laughlin | 210/113 X |
| 3,619,425 | 11/1971 | Blain et al. | 210/189 X |
| 3,797,660 | 3/1974 | Miller | 209/160 X |
| 3,862,029 | 1/1975 | Joyce | 209/208 X |

FOREIGN PATENT DOCUMENTS

| | | | |
|---|---|---|---|
| 1498139 | 1/1978 | United Kingdom | 210/33 |

*Primary Examiner*—Ralph J. Hill
*Attorney, Agent, or Firm*—Becker & Becker, Inc.

[57] ABSTRACT

A method of separating granular pourable materials in fluidized bed layers formed by fluid media. These layers are withdrawn by a fluidizing medium from the top downwardly one after the other down to slightly above the border surface of the lowest layer but one. Subsequently, the fluidizing medium which remains above the residual layer is rotated, and the residual layer is completely withdrawn by means of the thus created secondary radial flow toward the central region.

1 Claim, 4 Drawing Figures

METHOD OF SEPARATING GRANULAR POURABLE MATERIALS OF DIFFERENT DENSITIES IN A GASEOUS OR LIQUID MEDIUM

The present invention relates to a method for separating granular pourable materials of different densities in fluidized layers formed by gaseous or liquid media.

Granular pourable materials of different densities are utilized in the processing art for treating a gaseous or liquid medium. With decreasing efficiency of the pourable materials it is necessary to withdraw such materials from the process entirely or to introduce the same again into the process after they have been completely regenerated. Inasmuch as the pourable materials of different densities are, as a rule, mixed in a packed or fixed bed, the problem arises how to carry out a selective exchange of the individual components when the efficiency of the pourable materials has dropped to a predetermined degree.

It is therefore an object of the present invention to provide a method of the type described above by means of which it can be properly assured that the layers, which have been separated precisely in conformity with the different densities by the fluidization of a previously intermixed heap of pourable material, can without again intermixing be withdrawn one after the other also within the region of the border surfaces.

This object and other objects and advantages of the invention will appear more clearly from the following specification in connection with the accompanying drawings, in which.

Figure 1:
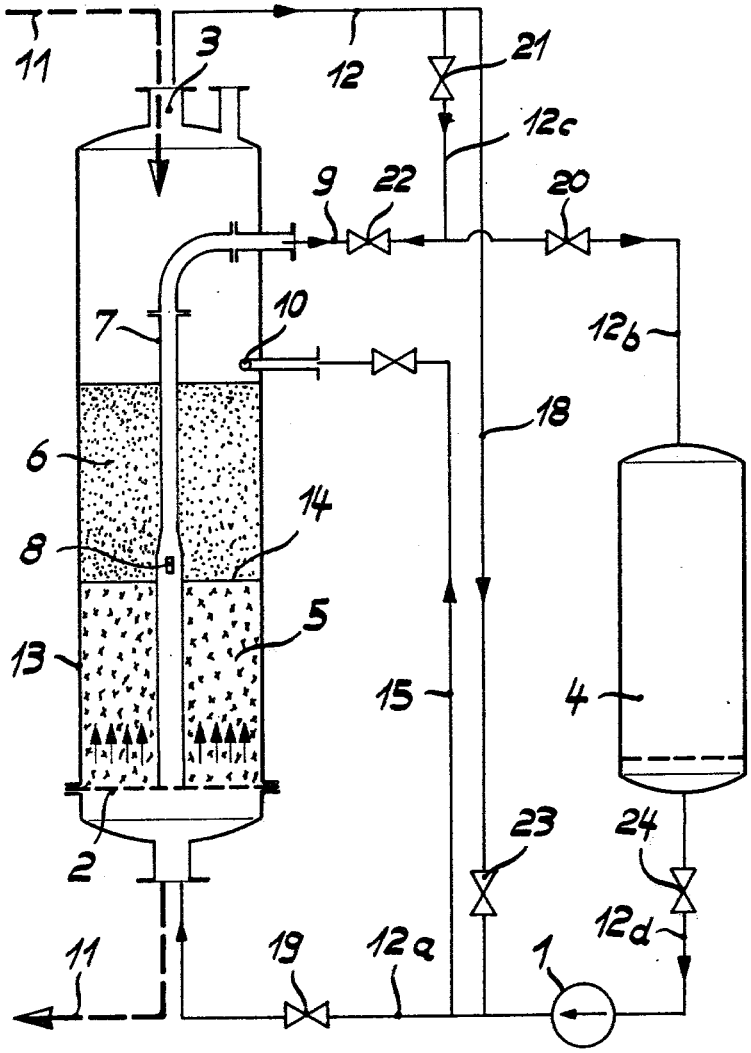
FIG. 1 is a diagrammatic illustration of an arrangement for carrying out the method according to the invention.

The method according to the present invention is characterized primarily in that the fluidized bed layers are withdrawn by a fluidizing medium from the top in downward direction one after the other down to shortly above the border surface of the next lower layer, whereupon the fluidizing medium located above the remaining residual layer is subjected to rotation, and the residual layer is completely withdrawn by way of the thus created secondary radial flow toward the central region.

The advantages realized by the method according to the present invention consist primarily in that in a process-technical simple manner it will be assured that the separation of a heap of pourable materials made up of substances having different densities can be effected properly according to density. In order to realize these advantages, advantage is taken physically of the fact that intermixed granular pourable materials with particles of different densities demix under the influence of gravity in a progressive non-reversible process when these pourable materials are fluidized at the highest loosening speed determined for the granules in conformity with the granular size, the granular density as well as the shape of the granules. The end of the demixing process consists in that a stable superimposition of separate fluidized bed layers is formed, the lowermost layer of which has the highest and the uppermost layer of which has the least average density of the densities of the fluidizing medium and of the respective particles or granules.

After these method steps known per se have taken their course, starting with the uppermost layer, and layers are spatially separated from each other. In this connection, for obtaining an exact demixing also within the region of the separating border with regard to the next following lower layer, a fluidization is carried out at a velocity which equals from one to two times the loosening speed of the respective lower layer.

The withdrawal of the fluidized bed layers is brought about by the fact that the respective layer material is withdrawn by the fluidizing substance which to this end flows off slightly above the separating border. During this operation, the material which successively sinks downwardly will, in view of its sinking movement, remain sufficiently fluidized. The conveying process is completed as soon as the layer surface has sunk to the border area of the influential region of the flow forces pertaining to the flowing off fluidizing medium which forces bring about the above mentioned transporting or conveying.

The remaining residual layer is removed by way of a secondary radial flow which forms in the direction of the central withdrawal of the fluidizing medium due to a slow rotation, of the remaining residual layer.

In the secondary radial flow the respective particles located at the surface and pertaining to the residual layer are successively transported from the rim or border of the layer to the withdrawal point and and discharged by the fluidizing medium. In this connection it is advantageous that the residual material which collects within the region of the withdrawal point passes last into the flowing off fluidizing flow. As a result thereof, the withdrawal point is screened from the border surface to the next lower fluidized layer, and the particles thereof are prevented from simultaneously passing with the particles of the residual layer into the transporting flow.

Referring now to the drawings in detail, it will be appreciated that after in the filtration operation the desired degree of exhaustion of the ion exchanger mixture has been realized, the filter-water circuit 11 is closed and the exchanger separation is initiated by flushing back via the back flushing circuit 12. The back flushing circuit 12 takes the following course in conformity with FIG. 1. By means of the circuit pump 1, the flushing back water flow is conveyed through the filter bottom 2 into the filtering container 13. The back flushing water flow leaves the filtering container 13 through a discharge conduit 3 which is possibly arranged centrally at the upper filter bottom. The back flushing water flow then flows back through the anion exchange container 4 to the circuit pump 1.

During the back flushing, two superimposed fluidized bed layers 5, 6 are formed in which connection the upper layer 6 contains the ion exchanger of lower density whereas the lower layer 5 contains the ion exchanger of higher density. The optimum flushing speed $w_{O1}$ for the ion exchanger separation amounts to about one to two times the loosening speed $w_{OL5}$ of the lower fluidized bed layer 5. The loosening speed $w_{OL6}$ of the upper specifically lighter vortex or whirl layer 6 is, assuming similar average granular size and also assuming similar distribution of the granules of both vortex layers, less than $w_{OL5}$. This results in a higher degree of fluidizing and a stronger layer expansion of the fluidized bed layer 6 relative to the fluidized bed layer 5 at the back flushing speed $w_{O1}$.

With the here utilized low back flushing speed $w_{O1}$, the separating effect is practically due only to the different gravity and driving forces of the ion exchangers, whereas flow forces are immaterial in this connection. As a result thereof, the thickness of the separating plane 14 between the fluidized bed layers 5, 6 amounts to about the magnitude of the diameter of an individual granule. Inasmuch as solely the density difference of the ion exchangers is utilized for the separation, it will be appreciated that with sufficiently long back flushing, any desired high separating grade can be realized.

For a mixing bed which consists of equal parts by volume of cation and anion exchangers and which in rest position has a total height of approximately 1400 mm, the duration of the back flushing up to the separation into two fluidized bed layers 5, 6 amounts to about 30 min at a back flushing speed of $w_{O1}=(1 \text{ to } 2)w_{OL5}$. For starting the separating operation, it is suggested to carry out a back flushing of about 15 min duration at a speed of $w_{O2}=2w_{O1}$.

Subsequently to the ion exchanger separation, the layer 6 is withdrawn through the open tubular body 7 and conveyed to the regenerating container 4. To this end, while maintaining the same back flushing speed $w_{O1}$, the water discharge 3 at the head end of the filter container 13 is closed and the conveying conduit 9 between the open tubular body 7 and the regenerating container 4 is opened. The circulating water now flows together with the ion exchanger 6 into the inlet openings 8 of the open tubular bodies 7 which are arranged above the separating plane 14. In this connection new layer material continuously sinks down from above whereby the fluidization necessary for the conveying action is maintained.

The distance of the lower edge of the inlet openings 8 from the separating plane 14 while the ion exchanger layers are at rest takes into consideration the expansion of the lower ion exchanger layer 5 which occurs at the back flushing velocity $w_{O1}$, and furthermore takes into consideration a safety distance which depends on the respective ion exchangers.

As soon as the level of the ion exchanger layer 6 has dropped down to about the lower edge of the inlet openings 8, the ion exchanger flow comes automatically to a standstill, and only non-charged circuit water flows to the regenerating container 4. During the ion exchanger flow off, the height of the layer decreases with the back flush speed $w_{O1}$ so that the flow off of the upper ion exchange layer 6 with an original height in rest position of 700 mm will be completed after from about 10 to 15 min.

The water volume still remaining in the filtering container 13 above the remaining ion exchanger fill is subjected to a slow rotation, for instance by a partial flow 15 of the circuit water flow 12, which exits from a pipe 10 arranged tangentially and at a right angle to the container axis in the vicinity of the wall.

Figure 2:
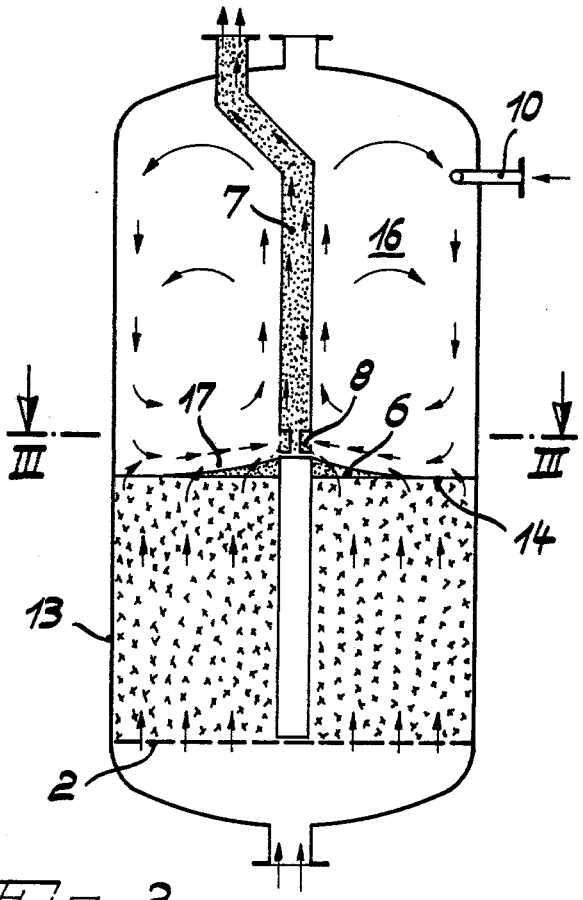
FIG. 2 is a longitudinal section through a mixing bed filter for use in connection with the arrangement of FIG. 1.
Figure 3:
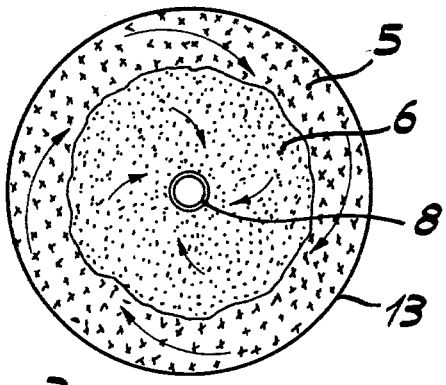
FIG. 3 is a transverse section taken along the line III—III of FIG. 2.
Figure 4:
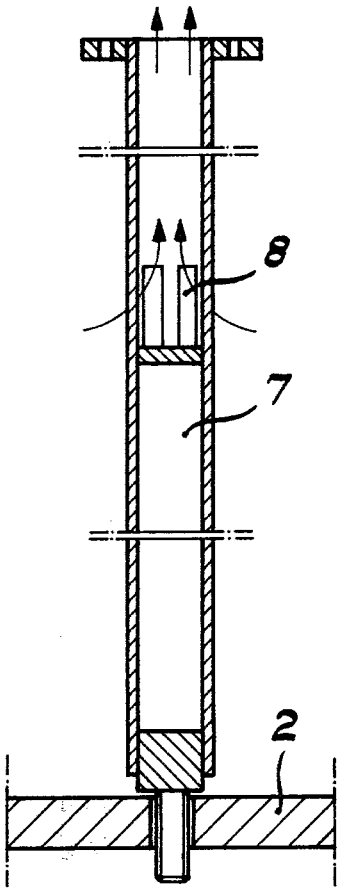
FIG. 4 shows a possible design of the insert which in central arrangement extends down to the filter bottom.

The rotation of the water in the filter chamber 16 of the fluidized bed layers in the vicinity of the free surface of the remaining upper fluidized bed to layer 6 bring about a secondary flow 17 (FIG. 2) which is directed radially to the filter axis. Together with the central ion exchanger withdrawal there will form the flow configuration of an inverted vortex sink which is diagrammatically illustrated in FIG. 3. In this inverted vortex sink, only the ion exchangers of the fluidized layer 6 are transported to the inlet openings 8 of the open pipe body 7 from where the ion exchangers 6 pass into the ion exchanger container 4. In this connection, the ion exchangers of the fluidized layer 6 which float at the top taken along and are flushed out of the filtering container 13. The transport of the ion exchangers stops automatically as soon as the fluidized layer 6 has been completely discharged.

The utilization of an inverted vortex for the discharge of ion exchangers is advantageous in different ways. An inverted vortex can easily be generated as point-symmetric flow independently of the size of the diameter in each filtering container of circular cross section symmetrically to the axis of the container. In view of the point-symmetry of the pressure and velocity values, no material deformations of the fluidized bed layer surface occur in circumferential direction which deformations otherwise would lead to flow movements in the fluidized bed layer, and these flow movements would interfere with the centrally directed resin discharge. Furthermore, the inverted vortex flow fills the entire cross section of the container so that, assuming a smooth container wall and a layer surface free from inserts, no dead flow areas can form in which undesired residues of the upper fluidized bed layer could accumulate.

The open pipe body 7 can without requiring any changes also be used for returning the regenerated ion exchanger. In this instance the back flushing through the filter bottom 2 does not occur. For this purpose the valve 19 in conduit **12*a* is closed and the transporting medium with the exchanger resin passes through conduit 12*b* and through conduit 9 by way of the open pipe body 7 into the filtering container 13, while valve 20 is open, valve 21 in conduit 12*c* is closed, and valve 22 is open. The transporting medium leaves the filtering container 13 through the conduits 12, 18 while the valve 23 in the conduit 18 is open and the valve 24 in the conduit 12*d* is likewise open and flows into the ion exchanger container 4. The pump 1** delivers, of course, in opposite direction.

The device described above operates in a sequence of individual steps which are initiated by standard actuating control and regulating armatures known per se and stops automatically after a predetermined time. This brings about the advantage that the ion exchanger separation can also be carried out by less skilled personnel. Furthermore, a sight contact to the various ion exchanger containers is not necessary so that such device can also be utilized in enclosed and shrouded nuclear plants.

It is, of course, to be understood that the present invention is by no means limited to the specific showing in the drawings but also comprises any modifications within the scope of the appended claims.

What I claim is:

1. A method of separating several granular pourable materials of different densities in fluidized bed layers including a lowest layer as well as a border surface of a next to the lowest layer formed by a fluidizing medium passing through each layer, which includes in combination the two steps of: first, successively withdrawing the layers above said lowest layer in sequence from top to bottom in downward direction from an axially located point slightly above the border surface of the next to the lowest layer, and secondly, rotating the fluidizing medium remaining above the residual portion of said next to the lowest layer, while completely withdrawing the residual portion with the aid of a secondary radial flow toward the central region created by rotating said fluidizing medium above said residual portion.

* * * * *